United States Patent [19]

Greer et al.

[11] 4,096,474

[45] Jun. 20, 1978

[54] APPARATUS FOR DETECTING PERSONS HIDDEN IN VEHICLES

[75] Inventors: Charles B. Greer, Clifton; Nathan Alter, Alexandria; David E. Locke, Manassas Park, all of Va.

[73] Assignee: The United States of America as represented by the Secretary of the Army, Washington, D.C.

[21] Appl. No.: 676,011

[22] Filed: Apr. 12, 1976

[51] Int. Cl.[2] ..... G08B 13/00

[52] U.S. Cl. ..... 340/261; 340/65; 340/279; 340/276

[58] Field of Search ..... 340/261, 65, 279, 276, 340/421

[56] References Cited

U.S. PATENT DOCUMENTS 3,668,675 6/1972 Joens et al. ..... 340/65

3,922,663 11/1975 Lubke et al. ..... 340/261

3,961,323 6/1976 Hartkorn ..... 340/65

*Primary Examiner*—Glen R. Swann, III

*Attorney, Agent, or Firm*—Nathan Edelberg

[57] ABSTRACT

A seismic detection system for detecting persons hidden in vehicles includes a seismic transducer used as a sensing device and electronic processing circuitry for processing the output signals from the seismic transducer. The electronic circuitry detects output signals from the seismic transducer, and, by counting the number of times the signal crosses a preset threshold during a given time window, makes a logic choice between there being personnel or no personnel in the vehicle. If a person or persons are in the vehicle an output is produced and this output is used to actuate audio and/or visual indicators thereby indicating that a person or persons are in the vehicle.

10 Claims, 1 Drawing Figure

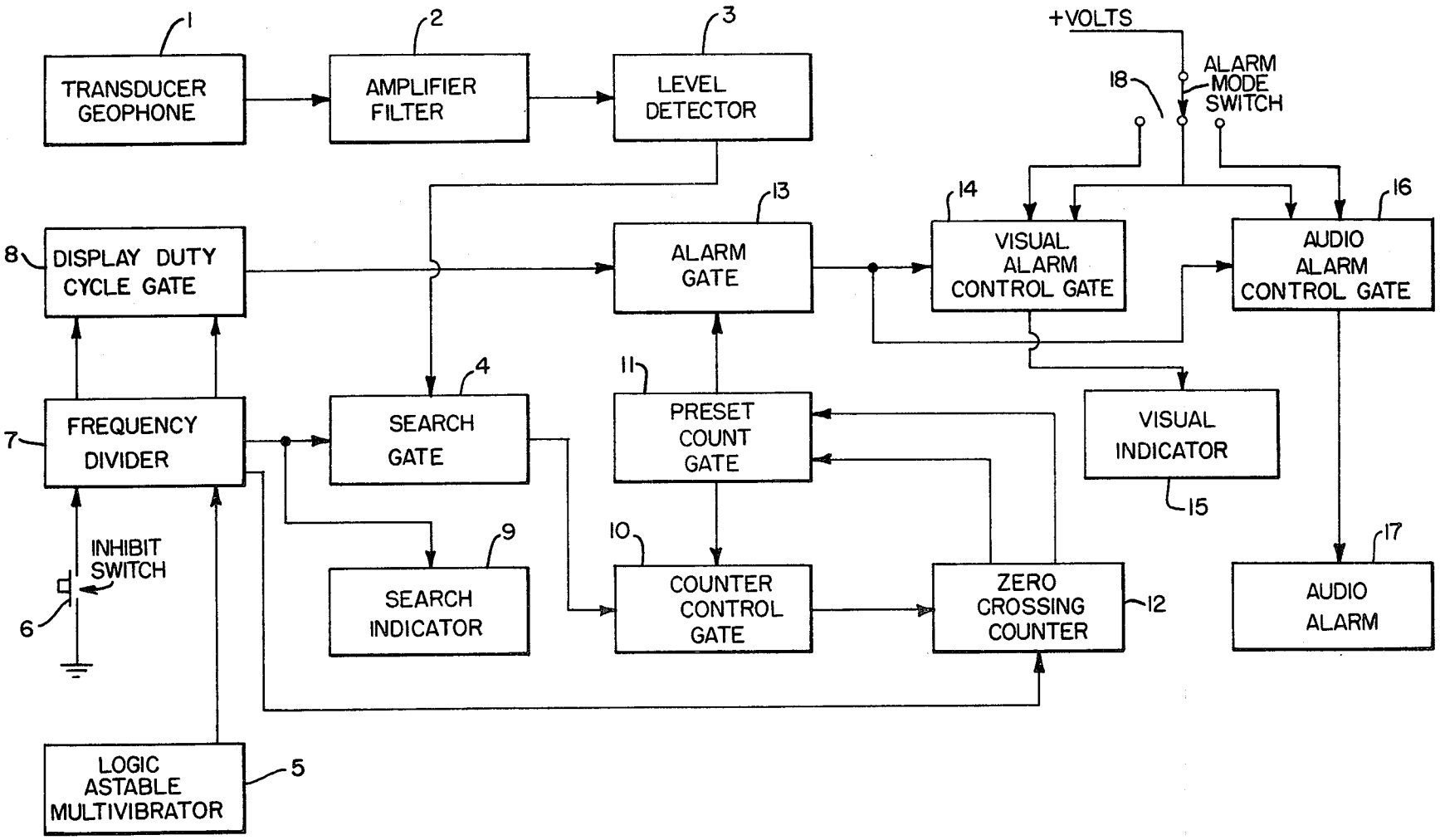
TRANSDUCER GEOPHONE
1
AMPLIFIER FILTER
2
LEVEL DETECTOR
3
SEARCH GATE
4
LOGIC ASTABLE MULTIVIBRATOR
5
INHIBIT SWITCH
6
FREQUENCY DIVIDER
7
DISPLAY DUTY CYCLE GATE
8
SEARCH INDICATOR
9
COUNTER CONTROL GATE
10
PRESET COUNT GATE
11
ZERO CROSSING COUNTER
12
ALARM GATE
13
VISUAL ALARM CONTROL GATE
14
VISUAL INDICATOR
15
AUDIO ALARM CONTROL GATE
16
AUDIO ALARM
17
ALARM MODE SWITCH
18
+VOLTS

APPARATUS FOR DETECTING PERSONS HIDDEN IN VEHICLES

The invention described herein may be manufactured, used, and licensed by or for the Government for Governmental purposes without the payment to me of any royalties thereon.

BACKGROUND OF THE INVENTION

This invention relates to seismic detection apparatus, and more particularly, to a seismic system for detecting the presence of unknown persons located in a vehicle.

Border guards are responsible for preventing illegal aliens from entering the United States. Very often such aliens attempt to enter this country by hiding in vehicles that are legally crossing the border. There are, of course, other instances when a person or persons may hide in a vehicle to avoid detection. For example, a person attempting to elude police may hide in a vehicle with or without the consent of the owner and may in that way elude detection by police. This invention provides a small compact portable system that detects the presence of persons hidden in a vehicle. The system need merely be placed on the vehicle and the presence of a person in the vehicle will automatically be detected. If the presence of a person or persons is indicated, a thorough search of the vehicle can be conducted to locate the hidden person or persons. Thus, the fact that a person or persons are hidden in a vehicle can be detected without first searching the vehicle. In addition to detecting the presence of hidden personnel, the apparatus of this invention can be used to detect any tampering with a vehicle.

SUMMARY OF THE INVENTION

The system of this invention operates on the principle that a mobile inanimate structure, such as an automotive vehicle, sufficiently flexible with respect the ground or any equivalent supporting surface as to have a distinct mass consideration. In accordance with the invention, the presence of a low level activating force causes the mobile inanimate structure to move in a characteristic manner, the characteristics are detected and, when a particular grouping of selected characteristics occurs, the nature of the low level activating force can be identified. It has been found that animate bodies, i.e., living things such as human beings, larger animals and the like, provide the requisite level of activating force to produce a detectable movement of a mobile inanimate structure. In particular, a low level signal generated by the body (heart beat, muscle reflection and breathing) will be amplified by the Q of the vehicle resonance. That is, the vehicle will act as a sounding board for these small body generated signals. Actual field tests have shown that the dominant signal from personnel located anywhere in a vehicle has a frequency range of 2 to 4 hertz and that the amplitude of this signal exceeds the static background noise by approximately 20 D.B. Further, these tests have shown that the low frequency signal generated by personnel hidden in a vehicle are in effect continuous as compared to the short duration signals generated by wind movement of the vehicle. The apparatus of this invention detects these low frequency body generated signals and processes these detected signals to produce a visual and/or audio indication of the presence of personnel in the vehicle being checked.

More specifically, the apparatus of this invention includes a seismic transducer to sense or detect the low frequency body generated signals and processing circuitry coupled to the output of the seismic transducer. The output signals from the seismic transducer are coupled to the processing circuitry which counts the number of times the signal from the transducer crosses a preset threshold during a given time window. On the basis of this count the circuitry makes a logic decision between there being personnel or no personnel in the vehicle. If the logic decision is that personnel are present in the vehicle, the circuitry provides a visual and/or audio indication of this fact.

The apparatus of this invention is constructed as a compact portable package which is placed on the vehicle being checked. After the apparatus is activated and placed on a vehicle, the apparatus automatically indicates whether or not a person or persons are located in the vehicle being checked. If the system discloses that a person or persons are hidden in the vehicle, a thorough search of the vehicle can be conducted to locate the hidden person or persons. The apparatus is easy to operate; therefore, no special skills are needed to conduct a vehicle check with the apparatus of this invention.

In addition to being used to detect personnel hidden in a vehicle, the invention can be used to detect vehicle tampering. The apparatus is merely placed on the vehicle and if a person enters or tampers with the vehicle, his presence will be detected. If the apparatus is so utilized, the output of the system would typically be coupled to a radio link to provide a signal at a remote location. A whole fleet of vehicles can be monitored remotely by providing each vehicle with a detector of this invention and coupling the output of each detector to a small transmitter incorporated in each detector.

BRIEF DESCRIPTION OF THE DRAWING

A complete understanding of the invention can be obtained from the following detailed description of the invention when read in conjunction with the drawing in which the single FIGURE shows a block diagram of a preferred embodiment of the invention.

DETAILED DESCRIPTION OF THE INVENTION

Referring to the drawing, a seismic transducer, the transducer geophone 1, is used as a sensor to detect signals generated by personnel hidden in a vehicle. The output of transducer geophone 1 is coupled to the input of an amplifier filter 2. The output of amplifier filter 2 is coupled to the input of level detector 3 and the output of level detector 3 is coupled to an input of the search gate 4.

The logic astable multivibrator 5 has its output coupled to an input of frequency divider 7. The inhibit switch 6 is also coupled to frequency divider 7. Frequency divider 7 has four outputs. The first output of frequency divider 7 is coupled to an input of search gate 4 and to the input of the search indicator 9. The second output of frequency divider 7 is coupled to an input of the zero crossing counter 12 and the third and fourth outputs of frequency divider 7 are each coupled to a different input of the display duty cycle gate 8.

The output of search gate 4 is coupled to one of two inputs of counter control gate 10. The other input of counter control gate 10 is coupled to one of two outputs of preset count gate 11 which has its other output coupled to an input of the alarm gate 13. The other input of alarm gate 13 is coupled to the output of display duty cycle gate 8.

The output of counter control gate 10 is coupled to one of the two inputs of zero crossing counter 12, the other input of zero crossing counter 12 being coupled to the second output of frequency divider 7. Zero crossing counter 12 has a first output and a second output which are coupled to first and second inputs, respectively, of preset count gate 11. Preset count gate 11 provides an output to both counter control gate 10 and alarm gate 13. The output of alarm gate 13 is coupled to the visual alarm control gate 14 and to the audio alarm control gate 16. The output of visual alarm control gate 14 is coupled to the visual indicator 15 and the output of audio alarm control gate 16 is coupled to the audio alarm 17. The alarm mode switch 18 is coupled to visual alarm control gate 14 and to audio alarm control gate 16.

A readily available integrated circuit such as RCA-CD 4011 could be used for the gates 4, 8, 10, 11, 13, 14 and 16. In addition, conventional semiconductor RCA-CD4047 could be used for the multivibrator 5 while an RCA-CD4024 could be used for the frequency divider 7 and counter 12. The search indicator 9 and visual indicator 15 may be conventional light emitting diodes (LED) devices while the audio alarm 17 may be a commercially available Sonalert.

By using suitable solid state circuitry and fabrication techniques, the detector system of this invention can be constructed as a relatively small lightweight portable unit. If a vehicle is to be checked, the detector unit is placed on the vehicle by the operator and inhibit switch 6 is closed. Inhibit switch 6 is provided to allow the operator to approach the vehicle to be checked with the unit in the ready state but inhibited from generating an alarm signal due to the movements of the operator. If any known occupants are in the vehicle they are required to get out of the vehicle and the unit is then placed on the vehicle and inhibit switch 6 is closed to activate the system. The operator must, of course, remove his hands from the detector unit after he activates the unit.

Transducer geophone 1 is designed to have the required sensitivity and frequency response to detect the two to four hertz signals that will be present if a person or persons are hidden in the vehicle.

The low level output signals from transducer geophone 1 are applied to amplifier filter 2 which is a high gain amplifier having low pass filter characteristics. Thus, amplifier filter 2 amplifies the signals from transducer geophone 1 and eliminates any higher frequency signals from other sources such as, for example, vehicle engine operating near the vehicle being checked, personnel walking nearby, and wind noise. The amplified filter signals from amplifier filter 6 are applied to level detector 3 which is so adjusted that a signal of approximately twice the background noise produces output pulses from level detector 3. The output pulses from level detector 3 are applied to an input of search gate 4.

The basic logic timing is provided by logic astable multivibrator 5 at approximately 30 hertz. Frequency divider 7 takes the output from logic astable multivibrator 5 and provides the following different required timing functions: The first count cycle (the initial output) from frequency divider 7 inhibits the logic or processing circuitry to allow amplifier filter 2 to stabilize. After this initial cycle, frequency divider 7 provides inputs to search indicator 9 and to search gate 4 to start the processing of the output pulses from level detector 3. During this time the unit is in the search mode. During the next cycle, the output from frequency divider 7 inhibits search gate 4 and search indicator 9.

During the search mode the search indicator 9 is on and search gate 4 is activated to pass the output pulses from level detector 3 to counter control gate 10. Search indicator 9 is merely a visual indicator such as a light that provides a visual indication of the fact that the unit is in the search mode. The pulses from search gate 4 pass through counter control gate 10 to zero crossing counter 12. Zero crossing counter 12 counts the number of times a zero crossing occurs during the search mode and if a preset number of zero crossings are counted, the output from zero crossing counter 12 will reset preset count gate 11. Preset count gate 11 is so adjusted that it will reset when it receives a given count number from zero crossing counter 12 during the search mode which is 4.22 seconds in duration. When preset count gate 11 is reset due to the receipt of the required number count from zero crossing counter 12, preset count gate 11 provides an output signal to counter control gate 10 and to alarm gate 13. This output signal from present count gate 11 inhibits counter control gate 10 and when inhibited, counter control gate 10 will not allow any more pulses from search gate 4 to pass through to zero crossing counter 12. At the end of the search mode, zero crossing counter 12 is reset by frequency divider 7 to place zero crossing counter 12 back to a zero count for the next search mode period.

If alarm gate 13 receives an output signal from present count gate 11 during the search mode thereby indicating that a proper count has been received from zero crossing counter 12, the unit can be considered to now be in an alarm mode. The unit may in effect still be in the search mode as far as search gate 4 and search indicator 9 are concerned but insofar as zero crossing counter 12 is concerned, the search mode has ended. In practice, preset count gate 11 is so adjusted that the number count required to reset this gate will not normally be reached until at or near the end of the 4.22 second search mode duration. Thus, when the unit starts the alarm mode, the search mode time duration will have lapsed or have nearly lapsed and search gate 4 and search indicator 9 will be inhibited by frequency divider 7 during all or most of the alarm mode time.

When alarm gate 13 is enabled by the output signal from present count gate 11, alarm gate 13 passes the output signals from display duty cycle gate 8 to visual alarm control gate 14 and to audio alarm control gate 16 thereby enabling these gates. If alarm mode switch 18 is closed on its center contact as shown in the drawing, both visual indicator 15 and audio alarm 17 will be activated thereby informing the operator that a person or persons are hidden in the vehicle. If switch 18 is closed on the right hand contact only audio alarm 17 will be activated and if switch 18 is closed on the left hand contact only visual indicator 15 will be activated. Whether switch 18 is closed on the right hand contact, the center contact or the left hand contact is purely a matter of choice, the choice being made by the operator. However, in some cases it may be desirable to use only visual indicator 15 to avoid alerting a hidden person that his presence in the vehicle has been detected. Display duty cycle gate 8 controls the length of time during which visual indicator 15 and/or audio alarm 17 are activated. At the end of this time period display duty cycle gate is disabled by frequency divider 7 and alarm gate 13 is thereby disabled. When alarm gate 13 is disabled, no signals can reach visual alarm gate 14 and audio alarm gate 16 and these gates are disabled, thereby deactivating visual indicator 15 or audio alarm 17 or both depending upon the position of switch 18. At the end of the alarm mode, the unit automatically begins a new search mode and the foregoing sequence of events is repeated.

In summary, the unit of this invention operates such that signals produced by personnel hidden in a vertical will produce the necessary number count from zero crossing counter 12 to activate the alarm circuits. These alarm circuits provide the operator with a visual and/or audio indication that one or more persons are hidden in the vehicle being checked. The time during which visual indicator 15 and/or audio alarm 17 are on and off in response to a given alarm count from zero crossing counter 12 is controlled by display duty cycle gate 8. This control of the on-off time of visual indicator 15 and audio alarm 17 is provided to conserve energy.

In addition to being used to detect personnel hidden in a vehicle, the detector unit of this invention can also be used to detect if someone is tampering with a vehicle. When used as a tampering detector, the unit is also placed on the vehicle and if anyone tampers with or enters the vehicle his presence will be detected in the same manner that a hidden person is detected. An entire fleet of vehicles can be so protected by placing a unit on each vehicle that is to be protected. In such usage visual indicator 15 and visual alarm control gate 14 could be eliminated with audio alarm 17 providing an audio signal of such magnitude that the signal can be heard at a remote location such as a guard station.

Preferably, however, if the detector unit is to be used to detect vehicle tampering and alert a person or persons located at a place remote from the vehicle, a small radio transmitter would be provided with each unit. This small radio transmitter would replace visual alarm control gate 14, audio alarm control gate 16, visual indicator 15, audio alarm 17, and alarm mode switch 18. That is, these circuit elements would be eliminated and the small radio transmitter would be coupled to the output of alarm gate 13 such that the transmitter would be activated by any output signals passing through alarm gate 13. The transmitter would be activated for a period of time determined by display duty cycle gate 8. The security personnel stationed at the remote location would be provided with a radio receiver tuned to the frequency of the radio transmitter so that the receiver will detect any signal from the transmitter. The output of the receiver could be coupled to a suitable visual and/or audio alarm. If a whole fleet of vehicles parked in a compound are to be protected using the detector units of this invention, each transmitter could be tuned to a different frequency and separate receivers each tuned to a different one of the transmitter frequencies and identified with a particular vehicle could be provided. If the number of vehicles is large, the use of differently tuned transmitters for each vehicle may be impractical. In such a case, groups of vehicles always parked in the same area could each be provided with detector units having the same transmitter frequency. This would reduce the number of receiver channels required at the security station and would still provide the security force with an indication of the general location of the vehicle from which the alarm signal is being transmitted. In addition to being used to protect vehicles parked in a compound, a detector unit with a transmitter could be secured to a vehicle with the unit activated by the driver each time he leaves his vehicle unattended. The driver would be provided with a portable receiver which would detect any alarm signal from his vehicle. The use of and activation of radio transmitter by alarm circuits is of course old and well known in the field of security alarms and for this reason a radio transmitter is not shown in the drawing. The radio transmitter would merely be coupled to the output of alarm gate 13 and activated by any signals from alarm gate 13. In this respect it is also noted that all of the circuit elements shown in the drawing by means of the various labelled boxes are all well known circuit elements available on the market.

While the invention has been described with reference to a specific embodiment, it will be obvious to those skilled in the art that various modifications can be made to this specific embodiment without departing from the spirit and scope of the invention as defined in the claims.

It is claimed that:

1. A detector unit for detecting the presence of animate bodies in the immediate vicinity of a mobile inanimate structure in a relatively low noise environment comprising:

a seismic transducer adapted to respond to low frequency signals in the single digit Hertz frequency range having at least a selected magnitude and adapted to produce an output signal representative of the frequency and magnitude of said low frequency signal, said low frequency signal being of the substantially continuous pulsating variety produced by heart and lung function in an animate body;

magnitude and frequency discriminator means connected to the output of said seismic transducer, said discriminator means adapted to discriminate between signals of continuous duration for a selected period of time and signals of other than continuous duration for said selected period of time, said discriminator means also adapted to discriminate between signals having a magnitude of at least a selected value and signals of lesser magnitude, said discrimination means having an output responsive to signals having a magnitude of at least said selected value and continuous for a selected period of time;

and alarm signal means connected to the output of said discriminator means and adapted to produce an alarm signal in response to an output signal therefrom representative of a detected signal of continuous duration for a selected period of time and further characterized by having at least a selected magnitude.

2. A detector unit as defined in claim 1 wherein said magnitude and frequency discriminating means comprises:

a search gate having a first input coupled to the output of said level detector, and having a second input and output;

a frequency divider having a first input, an inhibit input adapted to inhibit operation of said frequency divider and responsive to inhibiting means, a first output, a second output, a third output, and a fourth output, said first output of said frequency divider coupled to said second input of said search gate;

an astable multivibrator having an output coupled to said first input of said frequency divider;

an inhibiting means coupled to said inhibit input of said frequency divider;

a counter control gate having a first input coupled to said output of said search gate and having a second input and an output;

a zero crossing counter having a first input coupled to said output of said counter control gate, a second input coupled to said second output of said frequency divider and having a first and second output;

a preset count gate having a first input coupled to said first output of said zero crossing counter, a second input coupled to said second output of said zero crossing counter, a first output coupled to said second input of said counter control gate and a second output coupled to said alarm signal means; and a display duty cycle gate having a first input coupled to said third output of said frequency divider, a second input coupled to said fourth output of said frequency divider and an output coupled to said alarm signal means.

3. A detector unit as defined in claim 2 further including a search indicator coupled to said first output of said frequency divider.

4. A detector unit as defined in claim 3 wherein said alarm signal means includes an alarm gate having a first input coupled to said second output of said preset count gate, a second input coupled to said output of said display duty cycle gate and an output, said alarm gate providing an alarm signal on its said output in response to signals from said display duty cycle gate and from said preset count gate.

5. A detector unit as defined in claim 4 wherein said amplifier filter includes a low frequency pass band filter.

6. A detector unit as defined in claim 5 wherein said preset count gate provides an output signal to said alarm gate only when said zero crossing counter reaches a predetermined count.

7. A detector unit as defined in claim 6 wherein said seismic transducer is a transducer geophone designed to detect signals having a frequency range of two to four hertz.

8. A detector unit as defined in claim 7 wherein said alarm signal means further includes a visual alarm control gate having an input coupled to said output of said alarm gate and having an output;

a visual indicator having an input coupled to said output of said visual alarm control gate;

an audio alarm control gate having an input coupled to output of said alarm gate and having an output and;

an audio alarm coupled to said output of said audio alarm control gate.

9. A detector unit as defined in claim 1 wherein said seismic transducer is adapted to respond to signals in the 2–4 Hertz frequency range.

10. A detector unit as defined in claim 9 wherein said discriminator means is adapted to provide input signal magnitude discrimination and input signal duration discrimination in successive order as stated.

* * * * *